US007264230B2

(12) United States Patent
Burns et al.

(10) Patent No.: US 7,264,230 B2
(45) Date of Patent: Sep. 4, 2007

(54) CARBURETOR AND SOLENOID ASSEMBLIES AND METHODS OF ASSEMBLING THE SAME

(75) Inventors: Michael P. Burns, Millington, MI (US); David L. Speirs, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 313 days.

(21) Appl. No.: 11/032,918

(22) Filed: Jan. 11, 2005

(65) Prior Publication Data

US 2006/0151894 A1 Jul. 13, 2006

(51) Int. Cl.
*F02M 7/12* (2006.01)

(52) U.S. Cl. ..... 261/47; 251/129.15; 251/129.21; 261/DIG. 74

(58) Field of Classification Search ..... 261/45–47, 261/54–56, 63, DIG. 74; 251/129.15, 129.21, 251/129.22
See application file for complete search history.

(56) References Cited

U.S. PATENT DOCUMENTS 1,987,981 A * 1/1935 Tice ..... 261/70
2,034,048 A * 3/1936 Leibing et al. ..... 261/69.1
3,646,921 A * 3/1972 Marsee ..... 123/406.69
3,741,177 A * 6/1973 Schultz ..... 123/328
3,744,470 A * 7/1973 Clarke et al. ..... 123/198 DB
3,744,471 A * 7/1973 Braun et al. ..... 123/198 DB
3,780,718 A * 12/1973 Nambu et al. ..... 123/179.16
3,788,288 A * 1/1974 Harrison et al. ..... 123/328
3,861,366 A * 1/1975 Masaki et al. ..... 123/438
3,885,004 A * 5/1975 Marsee ..... 261/23.2
3,921,612 A * 11/1975 Aono ..... 123/438
3,933,951 A * 1/1976 Fischer et al. ..... 261/67
3,942,493 A * 3/1976 Linder et al. ..... 123/699
3,996,908 A * 12/1976 Brown et al. ..... 123/585
3,996,909 A * 12/1976 Fischer ..... 123/585
4,056,932 A * 11/1977 Nakamura et al. ..... 123/699
4,095,570 A * 6/1978 Sheffer et al. ..... 123/438
4,122,809 A * 10/1978 Iwasa ..... 123/678
4,132,194 A * 1/1979 Saito ..... 123/672
4,190,618 A * 2/1980 Sheffer ..... 261/50.1
4,268,462 A * 5/1981 Ota et al. ..... 261/40
4,291,860 A * 9/1981 Bauer ..... 251/129.02
4,360,482 A * 11/1982 Asai ..... 261/44.4
4,387,062 A * 6/1983 Tanaka ..... 261/23.2
4,434,111 A * 2/1984 Teramura et al. ..... 261/44.4

(Continued)

FOREIGN PATENT DOCUMENTS

GB 2037893 A * 7/1980 ..... 261/DIG. 74

(Continued)

*Primary Examiner*—Richard L. Chiesa
(74) *Attorney, Agent, or Firm*—Reising, Ethington, Barnes, Kisselle, P.C.

(57) ABSTRACT

An engine carburetor and a solenoid valve assembly therefor and methods of assembling the same. The carburetor has a body with a fuel and air mixing passage communicating with an air bleed passage. A cavity extends into the body for communication with the air bleed passage. A solenoid housing is received in the cavity and maintains a coil body for receipt of a valve body therein. The valve body moves between a retracted position to substantially open the air bleed passage and an extended position to substantially close the air bleed passage.

14 Claims, 6 Drawing Sheets

U.S. PATENT DOCUMENTS

| | | | | |
|---|---|---|---|---|
| 4,446,080 | A * | 5/1984 | Karino et al. | 261/39.5 |
| 4,519,367 | A * | 5/1985 | Nomura | 123/683 |
| 4,572,134 | A * | 2/1986 | Nouthuka et al. | 123/438 |
| 5,220,301 | A | 6/1993 | Haas et al. | 335/278 |
| 5,611,312 | A | 3/1997 | Swanson et al. | 123/436 |
| 5,722,367 | A | 3/1998 | Izydorek et al. | 123/339.13 |
| 6,267,102 | B1 * | 7/2001 | Parrullo et al. | 123/437 |
| 6,401,685 | B1 | 6/2002 | Warner | 123/198 DB |
| 6,581,916 | B1 * | 6/2003 | Shaw | 261/35 |
| 6,615,792 | B1 | 9/2003 | Grifka et al. | 123/198 DB |
| 6,702,261 | B1 * | 3/2004 | Shaw | 261/35 |
| 7,028,993 | B2 * | 4/2006 | Burns | 261/35 |
| 2005/0017378 | A1 * | 1/2005 | Burns | 261/35 |

FOREIGN PATENT DOCUMENTS

| | | | | |
|---|---|---|---|---|
| JP | 52-19825 A * | 2/1977 | | 261/DIG. 74 |

* cited by examiner

CARBURETOR AND SOLENOID ASSEMBLIES AND METHODS OF ASSEMBLING THE SAME

FILED OF THE INVENTION

This invention relates generally to carburetors for internal combustion engines, and more particularly to a carburetor and a solenoid valve assembly.

BACKGROUND OF THE INVENTION

Carburetors are used to provide fuel and air mixtures for a wide range of two-cycle and four-cycle engines, including hand held engines, such as engines for chain saws and weed trimmers, as well as a wide range of marine engine applications, for example. Diaphragm-type carburetors are particularly useful for hand held engine applications wherein the engine may be operated in substantially any orientation, including upside down. In an attempt to achieve more efficient operation and to reduce exhaust emissions from these engines, valves, such as solenoid valves, have been used to regulate the fuel and air mixture. While generally effective in reducing the harmful emissions to the atmosphere, the carburetors having solenoid valves require more time in assembly, thereby increasing the costs associated with the manufacture of the carburetors.

SUMMARY OF THE INVENTION

A diaphragm-type carburetor for an internal combustion engine has a solenoid valve assembly to regulate at least in part the air flow in the carburetor. A body of the carburetor has a fuel and air mixing passage extending therethrough and an air bleed passage in communication with at least a portion of the fuel and air mixing passage. The body has a cavity extending from an outer surface into the body and communicating with at least a portion of the air bleed passage. The solenoid valve assembly has a coil body with a generally cylindrical outer surface and an inner passage, and a valve body received at least in part in the passage of the coil body for reciprocation between a first position to at least partially obstruct the air bleed passage and a second position to substantially open the air bleed passage. To facilitate assembly of the solenoid valve assembly to the body of the carburetor, the solenoid valve assembly has a solenoid housing with an inner cavity sized to receive at least part of the coil body and an outer surface preferably sized for a press or friction fit within the cavity in the carburetor body.

Another presently preferred aspect of the invention provides a solenoid valve assembly that can be assembled to a body of a carburetor in a variety of different ways. The solenoid valve assembly can be assembled before being assembled into the body of the carburetor, or a solenoid housing may be assembled into the carburetor body, and thereafter the internal components of the solenoid valve assembly, including a coil body, a valve body, a spring and an end cap may be assembled within the solenoid housing and into the body of the carburetor in a "top-down" assembly fashion.

Another presently preferred aspect of the invention provides a solenoid valve assembly having component parts that are easy to assemble, and further, when assembled, remain secure and free from unintentional disassembly. The solenoid valve assembly has a solenoid housing with a base and a pair of end walls extending generally laterally from the base. One of the end walls has an opening and the other end wall has at least one slot extending laterally therein. A coil body has a generally cylindrical portion with a reduced diameter portion extending axially therefrom and sized for receipt in the opening in the end wall of the housing. The coil body also has a flange with one portion extending radially outwardly from the coil body and another portion extending generally laterally therefrom. A tab extends generally radially inwardly from the laterally extending flange portion for receipt in one of the slots in the solenoid housing when the reduced diameter portion is received in the opening. With the reduced diameter portion received in the opening, and the tab received in the slot, a magnetizable plate is received between the coil body and the end wall of the housing to prevent the solenoid assembly from being inadvertently disassembled.

Some of the objects, features and advantages of at least some of the embodiments of this invention include a carburetor having a solenoid valve assembly for at least partially closing and opening an air bleed passage within the carburetor that is relatively easy to assemble, reduces the cost of assembling the solenoid valve assembly, provides a unitized solenoid valve assembly that resists inadvertent disassembly, reduces the amount of machining required on the body of the carburetor to facilitate attachment of the solenoid valve assembly thereto, allows a solenoid valve assembly to be attached to a body of a carburetor in a variety of orientations, reduces the variances resulting from tolerance stack-up between related component parts within a solenoid valve assembly, decreases the amount of space occupied by a solenoid valve assembly attached to a carburetor, is rugged, durable, of relatively simple design, economical manufacture and assembly, and improves the running efficiency of the engine, and in service has a long useful life.

BRIEF DESCRIPTION OF THE DRAWINGS

These and other objects, features and advantages of this invention will become apparent from the following detailed description of the preferred embodiments and best mode, appended claims and accompanying drawings, in which:

DETAILED DESCRIPTION OF THE PREFERRED EMBODIMENTS

Figure 1:
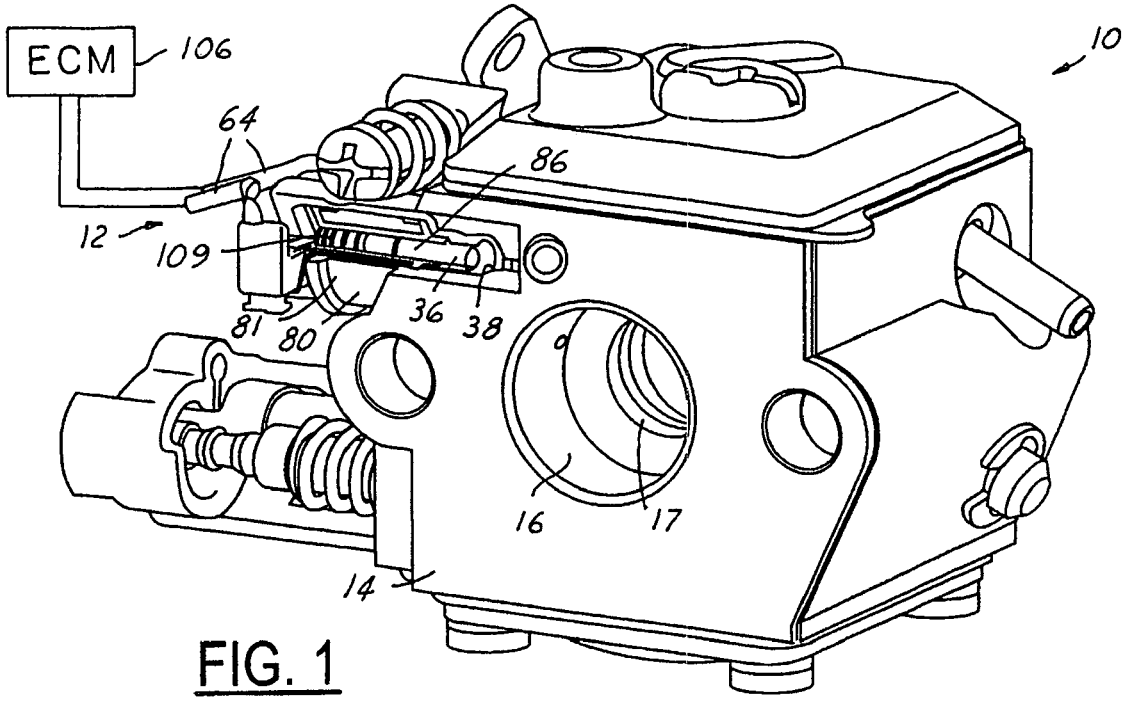
FIG. 1 is a perspective view of a carburetor assembly constructed according to one presently preferred embodiment of the invention.

Referring in more detail to the drawings, FIG. 1 illustrates a carburetor 10 having a solenoid valve assembly 12 constructed according to one presently preferred embodiment of this invention. The carburetor 10 has a main body 14 with a fuel and air mixing passage 16 extending therethrough (FIGS. 4 and 5) and having a throat or venturi portion 17 therein. The carburetor 10 is preferably a diaphragm-type carburetor, having a fuel pump, and a fuel metering assembly communicating with an outlet of the fuel pump through a diaphragm controlled valve, as disclosed in U.S. Pat. No. 6,267,102 to Pattullo et al, incorporated herein by reference in its entirety. The fuel pump draws fuel from a fuel source such as a fuel tank and delivers it to a fuel metering chamber 18 (FIGS. 4 and 5) that communicates with the fuel and air mixing passage 16 through a needle valve 20 and a pair of passages 22, 24. One of the passages 22 preferably operates as an air bleed and/or fuel feed passage, depending on the orientation of a throttle valve 26 within the fuel and air mixing passage 16, as discussed in more detail hereafter, while the other passage 24 operates primarily as a fuel and air passage.

Figure 4:
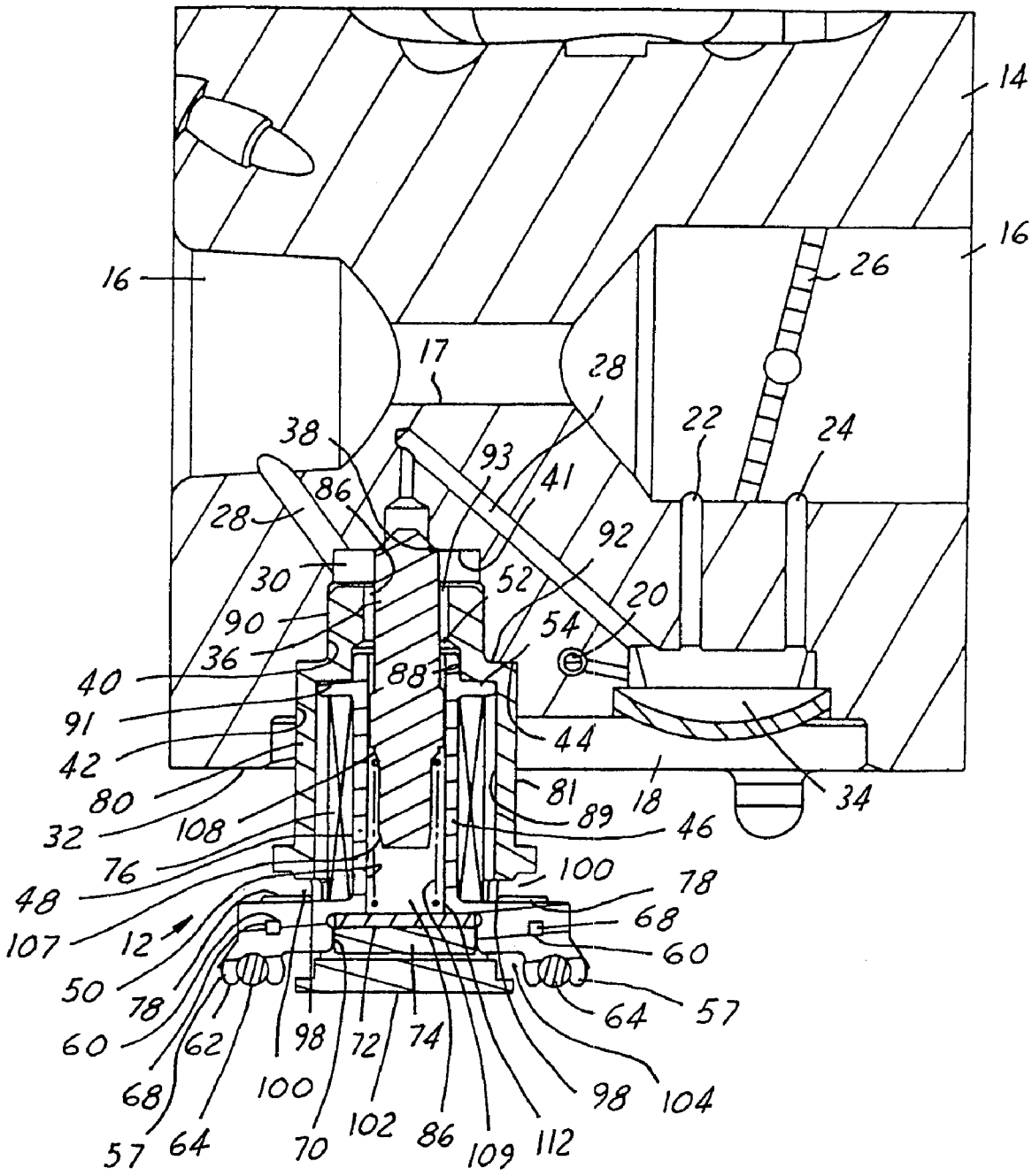
FIG. 4 is a cross sectional view of the carburetor assembly of FIG. 1 showing the solenoid valve assembly in a closed position.
Figure 5:
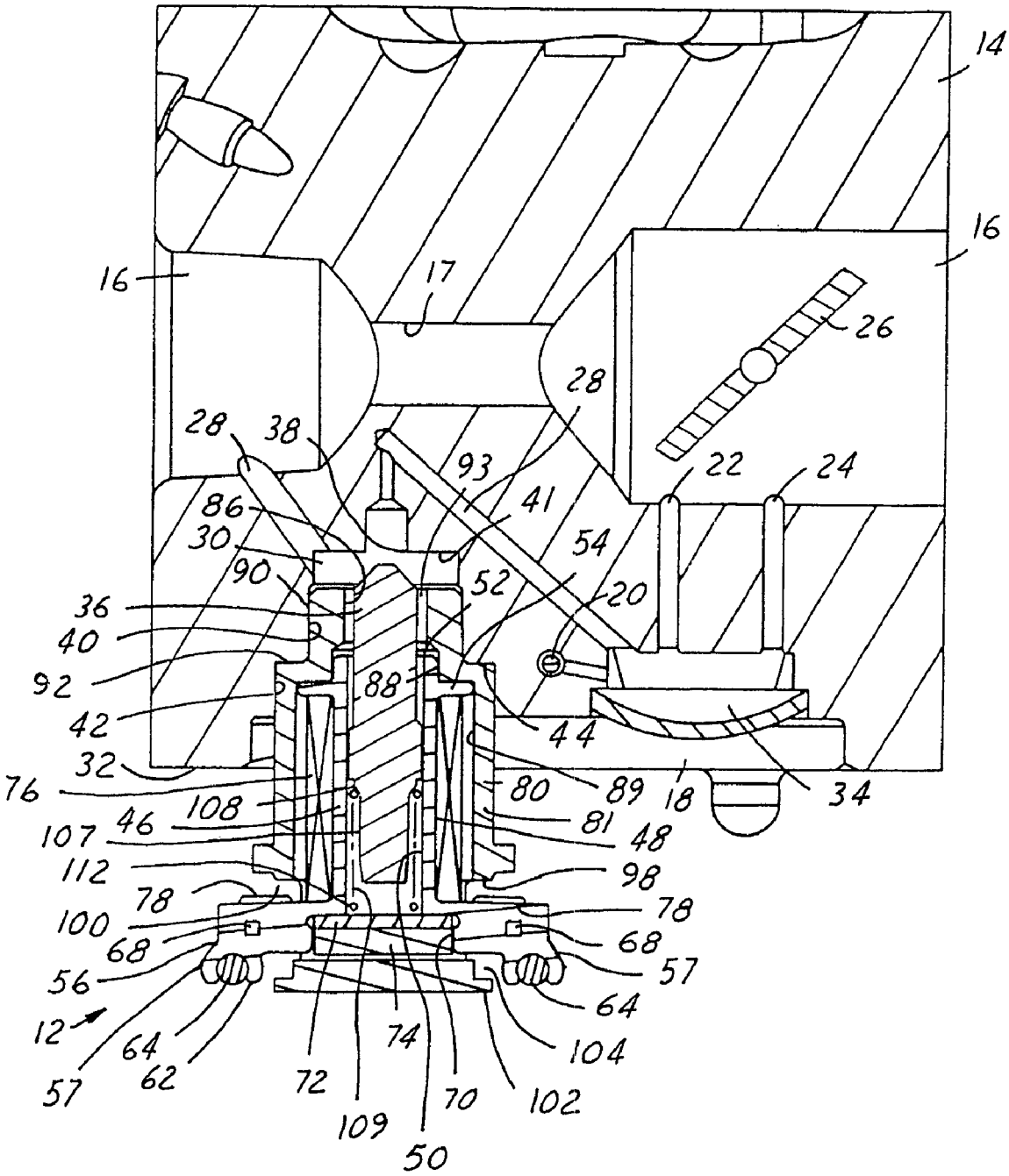
FIG. 5 is a view similar to FIG. 4 with the solenoid valve assembly in an open position.
Figure 7:
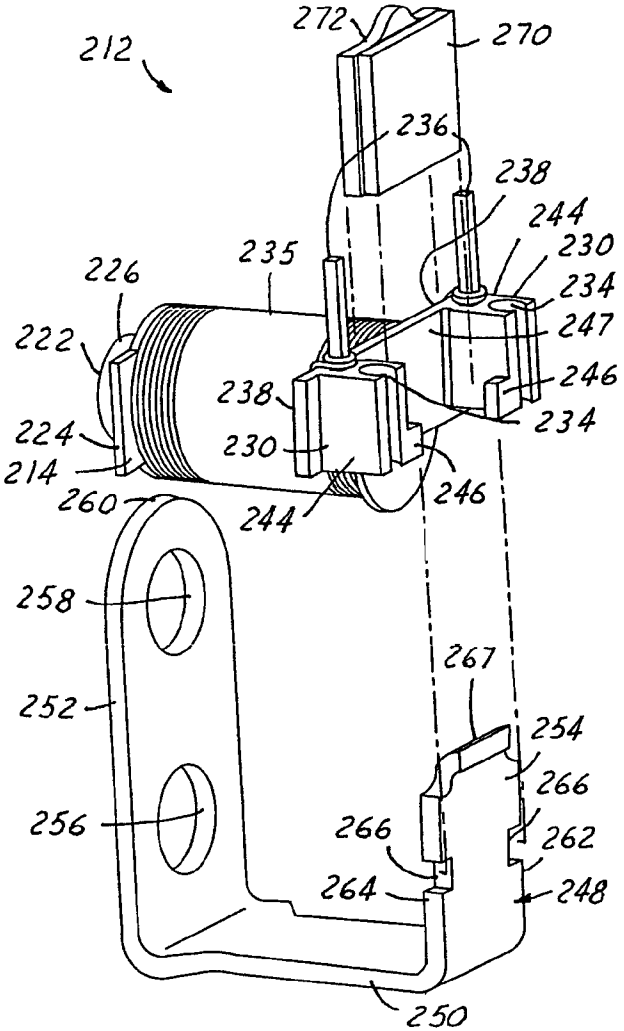
FIG. 7 is an exploded perspective view of the solenoid valve assembly of FIG. 6.

Still referring to FIGS. 4 and 5, the body 14 has another passage, shown here as an air bleed passage 28 communicating a portion of the fuel and air mixing passage 16 upstream of the venturi 17 with a portion of the fuel and air mixing passage 16 downstream of the venturi 17. The air bleed passage 28 extends through at least a portion of the body 14, shown here as extending from the fuel and air mixing passage 16 upstream of the venturi 17 to a cavity 30 that extends to an outer surface 32 of the body 14. The air bleed passage 28 extends from the cavity 30 to a fuel pocket 34 that is in communication with the passages 22, 24. Accordingly, when the throttle valve 26 is in an at least partially open position (FIG. 5) the air bleed passage 28 communicates with the fuel and air mixing passage 16 downstream of the venturi 17 through both passages 22, 24, and when the throttle valve 26 is in its closed or idle position (FIG. 4) the air bleed passage communicates with the fuel and air mixing passage downstream of the throttle valve 26 via the passage 24.

The cavity 30 extending into the body 14 communicates one portion of the air bleed passage 28 upstream of the cavity 30 with another portion of the air bleed passage 28 downstream of the cavity 30. Desirably, the cavity 30 has an enlarged diameter portion 42 generally adjacent the outer surface 32 of the body 14. The enlarged diameter portion 42 extends into the body 14 and preferably transitions to a reduced diameter portion 40, thereby defining an annular shoulder 44 between the enlarged and reduced diameter portions 42, 40. The reduced diameter portion 40 has a base 41 with an annular valve seat 38 through which the air bleed passage 28 passes.

Figure 2:
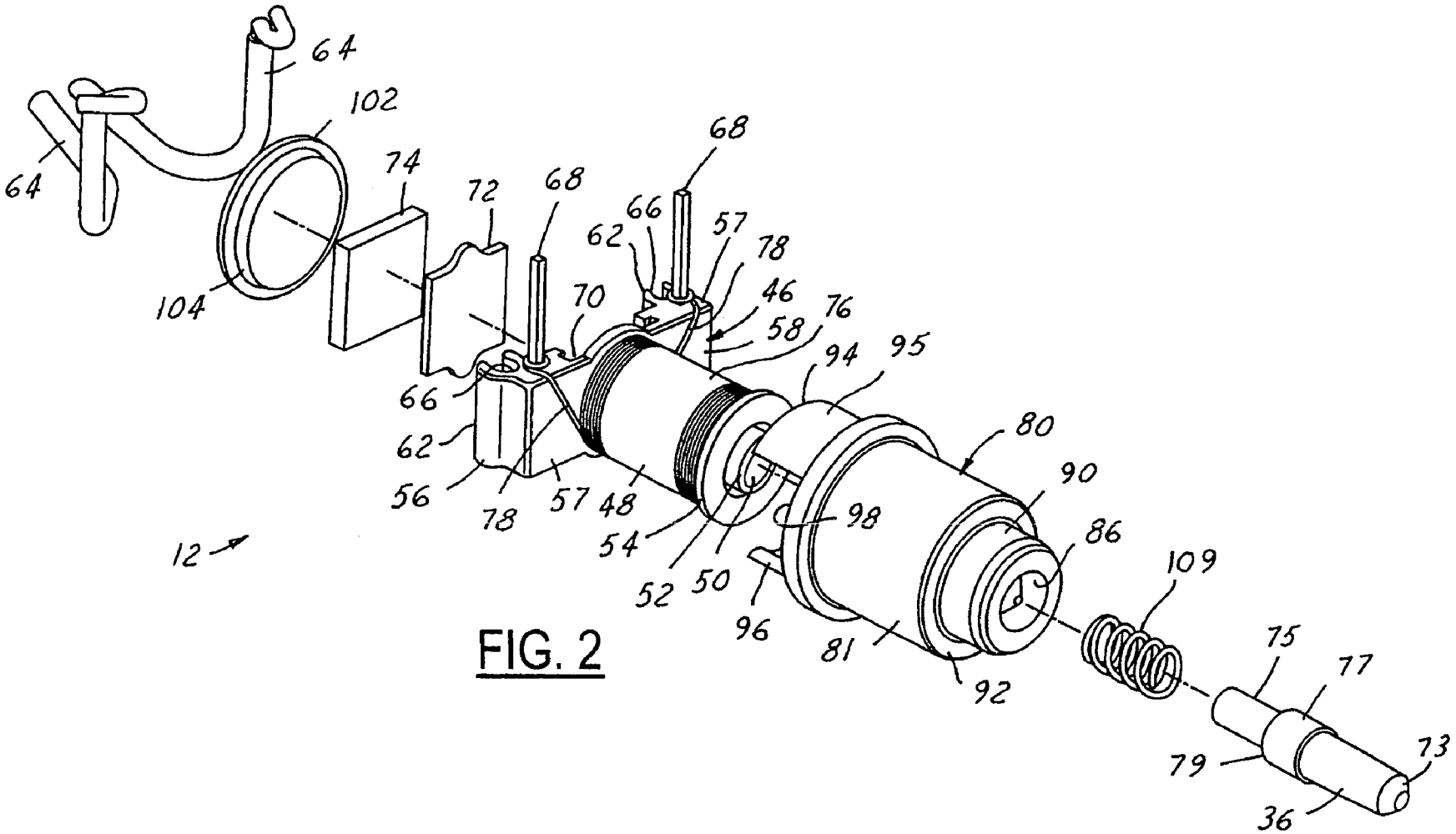
FIG. 2 is an exploded view of a solenoid valve assembly according to one presently preferred embodiment of this invention.

As shown in FIGS. 2, 4, and 5, the solenoid valve assembly 12 has a coil body 46 desirably constructed from a non-magnetic polymeric material with a generally cylindrical portion 48 defining at least a portion of an inner passage or valve passage 50 that extends at least partially and preferably completely through the coil body 46. Adjacent to one end 52, the coil body 46 has an annular and radially outwardly extending flange 54, and has a pair of outwardly extending flange portions 57 at its other end 62. As shown in FIGS. 2, 4 and 5, the coil body 46 has a pocket or recess 70 extending axially inwardly from the end 62 and sized to at least partially receive a plate of ferromagnetic or magnetizable material 72, such as steel, and a magnet 74 at least partially therein, the function of which is discussed in the operation discussion hereafter. The coil body 46 preferably has a wire coil 76 disposed about the cylindrical portion 48 and between the flange 54 and the flange portions 57.

Figure 3:
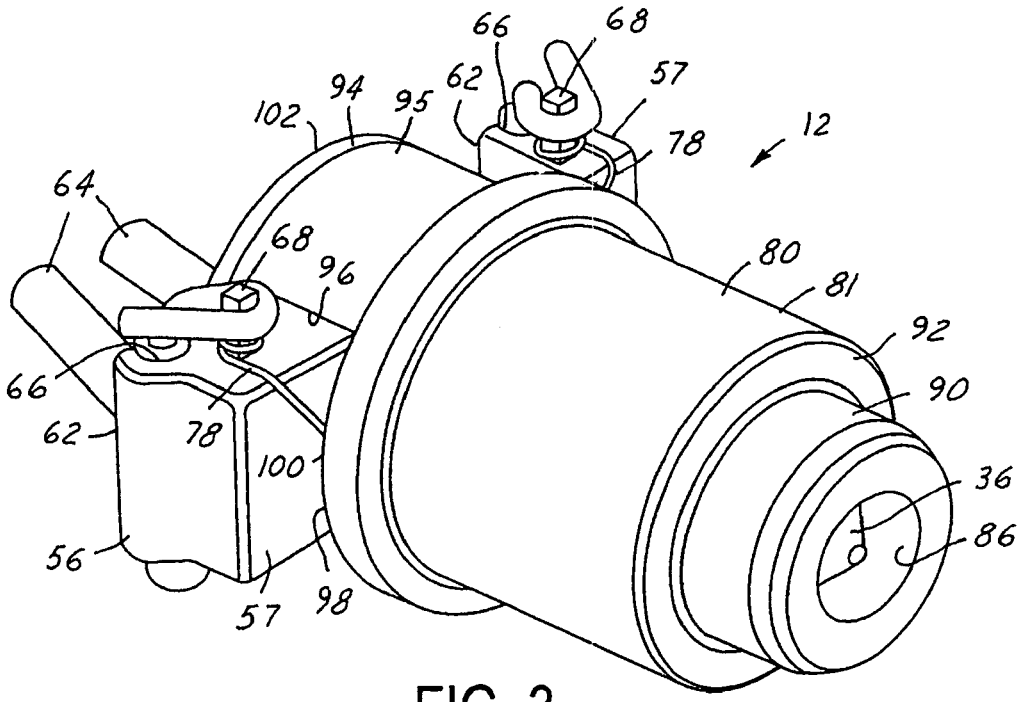
FIG. 3 is an assembled view of the solenoid valve assembly of FIG. 2.

As shown in FIGS. 2 and 3, to facilitate attachment to the solenoid valve assembly 12 of the ends of wires 64 that, for example, provide power to the solenoid valve assembly 12, the bracket 56 has a pair of spaced apart arcuate channels 66 in the flanges 57 that are preferably partially cylindrical to receive the wires 64, such as by a snap-fit. Preferably, to better retain the wires 64 within the channels 66, the minimum gap in each channel 66 is less than or sized closely to the outer diameter of its corresponding wire 64. To further facilitate electrical communication of the wires 64 with the solenoid valve assembly 12, the coil body 46 preferably has a pair of electrically conductive posts 68, with each of the posts 68 being carried by a separate one of the flanges 57 so that the wires 64 can be connected to the posts 68. The posts 68 may be molded integrally within the coil body 46 or otherwise carried in molded pockets 60 (FIG. 4) in the coil body 46. Each post 68 is attached to a separate one of the ends on the wires 64, such as through a solder joint or by wrapping the wire ends about the posts 68, so that the coil 76 is in electrical communication with the wires 64 via the posts 68. The ends of the coil 76 could be extended for electrical communication outside of the solenoid valve without the posts 68 and wires 64.

A valve body 36 preferably constructed from a magnetic ferrous material, such as steel, is slidably received in the valve passage 50 for linear reciprocation between a first or extended position, and a second or retracted position, by way of example without limitation. The valve body 36 reciprocates in the valve passage 50 in response to an electromagnetic field generated upon actuation of the coil 76. The valve body 36 has a tapered or conical head 73 shaped for sealed engagement with the valve seat 38 when in its extended position, a shank having a reduced diameter portion 75 sized for receipt of a spring, such as a coil spring 109, and an enlarged diameter outer or bearing surface 77 sized for close slidable receipt in at least a part of the valve passage 50. In assembly an end of the spring 109 bears on a shoulder 79 that is defined between the reduced diameter portion 75 and the bearing surface 77.

The valve body 36 is preferably yieldably biased toward one of its extended and retracted positions, and is shown here as being biased toward its extended position by the spring 109, with one end of the spring 109 abutting the shoulder 79 and the other end of the spring abutting the plate 72. When the valve body 36 is in its extended position engaged with the valve seat 38 to close the air bleed passage 28, the force of the spring 109 maintains the valve body 36 in its extended position against the opposite force produced by the magnetic attraction exerted by the magnet 74, as long as the coil 76 is not actuated. When the coil 76 is actuated, the electromagnetic field of the coil 76 overcomes the bias of the spring 109, thereby moving the valve body 36 to its retracted position, and thus, opening the air bleed passage 28. When the valve body 36 is in its retracted position, the magnetic force exerted by the magnet 74 maintains the valve body 36 in its retracted position against the bias exerted by the spring 109, as long as the coil 76 is not actuated. Accordingly, the spring 109 and the magnet 74 act to maintain the valve body 36 in its respective extended and retracted positions, and the coil 76 may be energized to selectively drive the valve body 36 therebetween from either position to the other. It should be recognized that the magnet 74 and the spring 109 could be arranged to bias the valve body 36 in the extended or retracted positions, respectively, if desired.

The solenoid valve assembly 12 has a solenoid housing 80 preferably formed from a ferromagnetic material, such as steel, by way of example and without limitation. The solenoid housing 80 has a generally cylindrical main body 81 with a through bore 86 and first and second counterbores 88, 89 sized to at least partially receive the coil body 46. A shoulder 91 is defined between the counterbores 88, 89 and is engaged by the flange 54 of the coil body 46 during insertion of the coil body 46 within the solenoid housing 80 to limit insertion of the coil body 46 therein. Desirably, the bore 86 defines at least in part the valve passage 50 for receiving at least a portion of the valve body 36. The bore 86 preferably is sized for relatively close receipt of a portion of the valve body 36 with an annular gap 93 being defined therebetween sized to allow a magnetic field to cross the gap. This facilitates movement of the valve body from its extended position toward its retracted position.

The main body 81 has a reduced diameter end or nose portion 90 preferably equal or slightly greater in diameter than the reduced diameter portion 40 of the cavity 30 to provide a friction or press fit therein as the solenoid housing 80 is received in the body 14. Desirably, the main body 81 is sized for a friction fit within the enlarged diameter portion 42 of the cavity 30 in the carburetor body 14. To facilitate locating the solenoid housing 80 axially within the cavity 30, a generally annular shoulder 92 defined between the reduced diameter end 90 and the main body 81 preferably abuts the shoulder 44 in the cavity 30. Accordingly, in assembly, the solenoid housing 80 may be press fit within the cavity 30 in any circumferential orientation to facilitate connection to other components like electrical wires and to a predetermined depth defined by the mating engagement of the shoulder 44 in the carburetor body 14 with the shoulder 92 of the solenoid housing 80. When assembled in this manner, the time and cost required to assemble the solenoid valve assembly 12 into the carburetor body 14 are reduced. For example, since threaded fasteners are not needed to retain the solenoid, the time and cost to form threaded holes is eliminated. Assembly time is also reduced by eliminating the need to secure the solenoid with threaded fasteners. The press-fit receipt of the solenoid also provides a seal around the solenoid to prevent contaminants from fouling the solenoid.

As best shown in FIGS. 2 and 3, the main body 81 of the solenoid housing 80 extends to another end 94 having axially and circumferentially extending tabs 95 with gaps 96 defined therebetween. The gaps 96 are sized to receive the flanges 57 of the coil body 46. As shown in FIGS. 2-5, preferably the tabs 95 extend from a base 98, and when the coil body 46 is received in the counterbore 88 of the solenoid housing 80, a space 100 (FIGS. 3-5) is defined between the flanges 57 and the base 98 of the solenoid housing 80. The space 100 provides clearance for the ends 78 of the coil 76 between the flanges 57 and the base 98 so that the coil 76 does not create an electrical short circuit with the solenoid housing 80.

In addition, when the coil body 46 is assembled in the solenoid housing 80, a portion of the coil body 46 is preferably spaced axially inwardly from the end 94 to facilitate attachment of an end cap 102 in sealing engagement with the end 94. Desirably, the end cap 102 has a reduced diameter portion 104 sized for a press fit within the tabs 95 adjacent the end 94. Further, to eliminate or reduce axial play between the magnet 74, plate 72 and coil body 46, desirably the reduced diameter portion 104 abuts the magnet 74 to press the magnet 74, plate 72, and coil body 46 axially against one another. It should be recognized that the solenoid valve assembly 12 may be assembled prior to or during assembly of the carburetor 10. As such, the solenoid valve assembly 12 may be assembled to the main body 14 in a so-called top-down fashion wherein the components are assembled to the main body, preferably starting with the solenoid housing 80, followed by the coil body 46, the valve body 36, the spring 109, the plate 72, the magnet 74, and then the end cap 102.

In operation, to move the valve body 36 between its retracted and extended positions, the solenoid valve assembly 12 is in electrical communication with an engine control module 106 (FIG. 1) to receive signals therefrom. The engine control module (ECM) 106 is preferably responsive to at least one, and preferably a plurality of variables that can affect the initial start-up and continued running performance of the engine, such as whether the engine is running or not, throttle position, RPM, temperature, and any other variables that affect the starting and running engine performance. Accordingly, the ECM 106 can be preprogrammed to send an electric signal to the solenoid valve assembly 12 to actuate the valve body 36, as desired, so that the carburetor 10 operates efficiently, thereby providing an optimal starting and running performance of an engine of a vehicle incorporating the carburetor 10.

Generally, as the engine is turned off, the ECM 106 sends a signal to the solenoid valve assembly 12 to energize the coil 76 by applying an electrical current to the wire coil 76 via the wires 64 and the posts 68. The force exerted by the energized coil 76 overcomes the force exerted by the magnet 74 on the valve body 36 and in combination with the force of the spring 109, the valve body 36 is moved to its extended position. To facilitate moving the valve body 36 between its extended and retraced positions, the counterbore 88 portion of the valve passage 50 preferably has a surface substantially adjacent at least a portion of the valve body 36 to promote a magnetic field being established across the annular gap 93 between the solenoid housing 80 and the valve body 36. The magnetic field acts on the valve body 36 during actuation of the coil 76. In its extended position, the valve body 36 engages the valve seat 38 to close off the air bleed passage 28. With the valve body 36 in its extended position, the spring 109 exerts a strong enough force on the valve body 36 to maintain the valve body 36 in its extended position against the force exerted on the valve body 36 by the magnet 74 so that the coil 76 need not remain energized to retain the valve body 36 in its extended position. Accordingly, when the engine is started, the fuel and air mixture in the fuel and air mixing passage 16 is richer than normal since air is not channeled to or free to flow through the air bleed passage 28 to the fuel within the fuel pocket 34. The richer fuel and air mixture discharged from the carburetor 10 facilitates a cold start of the engine, and warming-up and initial stable operation of the engine.

When the engine speed reaches a predetermined RPM value or range, as preferably programmed within the ECM 106, the ECM 106 sends a signal to the solenoid valve assembly 12, thereby energizing the coil 76. The coil 76 exerts a strong enough force to overcome the force exerted on the valve body 36 by the spring 109, and thus, moves the valve body 36 from its extended position to its retracted position. Accordingly, the air bleed passage 28 is opened to allow air from the fuel and air mixing passage 16 upstream of the venturi 17 to flow into and through the fuel pocket 34, thereby providing a leaner fuel and air mixture to the fuel and air mixing passage 16 than when the air bleed passage 28 was closed. With the valve body 36 in its retracted position, the magnet 74 exerts a strong enough attraction force on the valve body 36 to maintain the valve body 36 in its retracted position against the force exerted by the spring 109 on the valve body 36 so that the coil 76 need not remain energized to retain the valve body 36 in its retracted position. As such, the engine receives a leaner air and fuel mixture to optimize the running performance of the engine per the programmed instructions of the ECM 106. It should be recognized that the coil 76 is capable of moving the valve body 36 both to it extended and retracted positions by altering the direction of current flow through the coil 76, as desired and instructed by the ECM 106.

Therefore, the ECM 106, pursuant to its preprogrammed instructions, operates to send electrical current to the solenoid valve assembly 12 to move the valve body 36 between its retracted and extended positions to optimally control the fuel and air mixture supplied to the engine to optimize the running performance of the engine. For instance, while accelerating the vehicle, it is generally desirable to enrich the fuel and air mixture to ensure sufficient fuel is provided to the engine to support the increase in fuel demand during acceleration. Therefore, during acceleration, the ECM 106 can send a signal to the solenoid valve assembly 12 to move the valve body 36 to its extended position, thereby closing off the air bleed passage 28 and enriching the fuel and air mixture. On the other hand, when decelerating, and to avoid a so-called rich come-down condition, wherein more fuel is provided than is needed, the ECM 106 can send a signal to the solenoid valve assembly 12 to move the valve body 36 to its retracted position, thereby opening the air bleed passage 28 to lean out the fuel and air mixture. As such, it should be recognized that depending on the preprogrammed instructions within the ECM 106, the solenoid valve assembly 12 can be operated to move between its retracted and extended positions to optimize the running performance of the engine. In addition, sensors can be employed to communicate with the ECM 106 to communicate such things as the fuel and air ratio of exhaust emissions, the fuel and air mixture ratio in the fuel and air mixing passage 16, the position of the throttle valve 26, and the like to facilitate the optimal operation of the solenoid valve assembly 12 to provide optimum engine running efficiency and performance.

In FIGS. 6-10, another embodiment of a solenoid valve assembly 212 is shown. The solenoid valve assembly 212 provides a unitary assembly preventing the inadvertent removal of subcomponents during attachment of the solenoid valve assembly 212 to a body of a carburetor.

Figure 10:
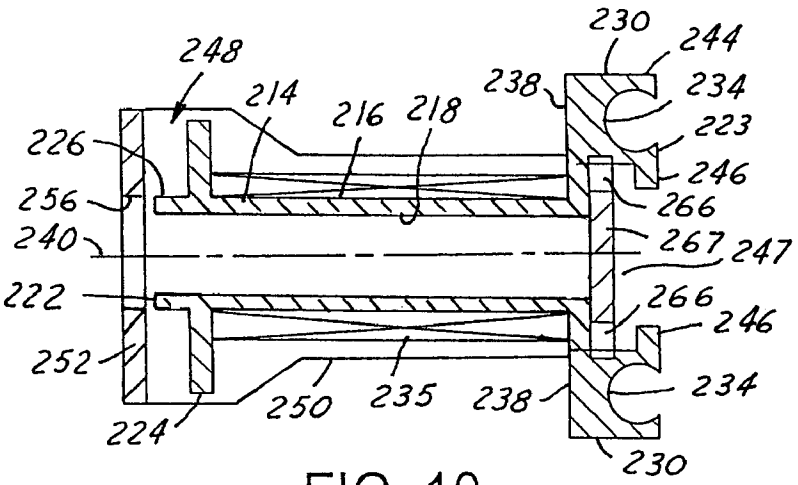
FIG. 10 is a cross sectional view of the solenoid valve assembly of FIG. 8.
Figure 11:
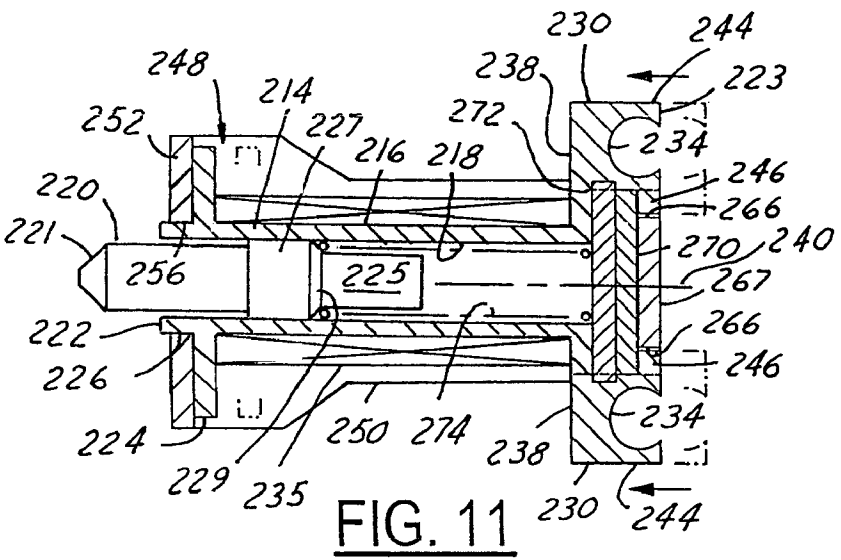
FIG. 11 is a cross sectional view of the solenoid valve assembly of FIG. 6.

The solenoid valve assembly 212 preferably has a coil body 214 constructed similarly to the coil body 46 in the previous embodiment. As shown in FIGS. 10 and 11, the coil body 214 has a cylindrical portion 216 with a bore 218, at least one outwardly extending flange 224 preferably axially spaced from one end 222 of the body 216 providing an axially extending reduced diameter end or nose portion 226. At its other end 223, the body 216 preferably includes a wall 238 extending generally perpendicular to an axis 240 of the bore 218 and including two fingers or flanges 230 extending axially from the wall 238 and having arcuate channels 234 to receive and retain wires as in the first embodiment. Preferably, each flange 230 has an inwardly extending tab 246 extending generally toward the longitudinal axis 240 such that the tabs 246 extend into and define part of a pocket 247 between the flanges 230. Further, as in the previous embodiment, the coil body 214 preferably carries a pair of electrically conductive posts 236, with each post 236 connected to a separate end of the coil 235. The wire coil 235 is wound about the coil body with each end of the coil 235 being connected to a separate one of the posts 236.

A valve body 220 is slidably received in the bore 218 for linear reciprocation between a first or extended position and a second or retracted position. The valve body 220 has a tapered or conical head 221, a shank having a reduced diameter portion 225, and an enlarged diameter outer or bearing surface 227 sized for close slidable receipt in the bore 218. A shoulder 229 is defined between the reduced diameter portion 225 and the bearing surface 227. The valve body 220 is preferably yieldably biased toward its extended position by a spring 274 engaging the shoulder 229 and the plate 272.

The solenoid valve assembly 212 has a generally U-shaped solenoid housing 248 with a base 250 and a pair of outwardly extending end walls 252, 254. One of the end walls 252 has at least one opening and is shown here with a pair of openings 256, 258. One of the openings 256 is generally cylindrical and sized to receive the nose portion 226 of the coil body 214 for a close fit, such as a line-to-line fit or a slight press fit, for example. The opening 256 is spaced from the base 250 a predetermined distance to ensure that the coil body 214 can be assembled within the solenoid housing 248 without interference from the base 250. The other opening 258 is located generally between the opening 256 and an end 260 of the end wall 252. The opening 258 is sized to receive a fastener, such as a machine screw (not shown), for example, to facilitate attaching the solenoid valve assembly 212 to a carburetor body.

Figure 6:
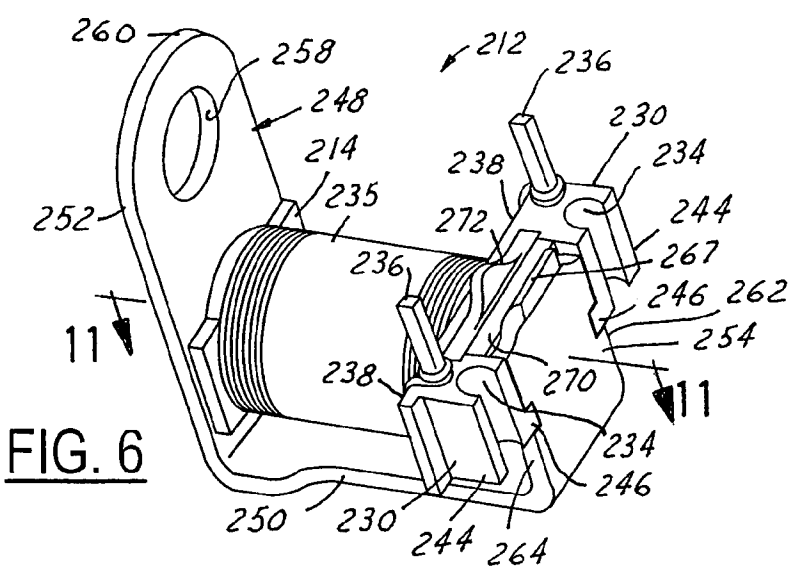
FIG. 6 is a perspective view of a solenoid valve assembly constructed according to another presently preferred embodiment of the invention.
Figure 8:
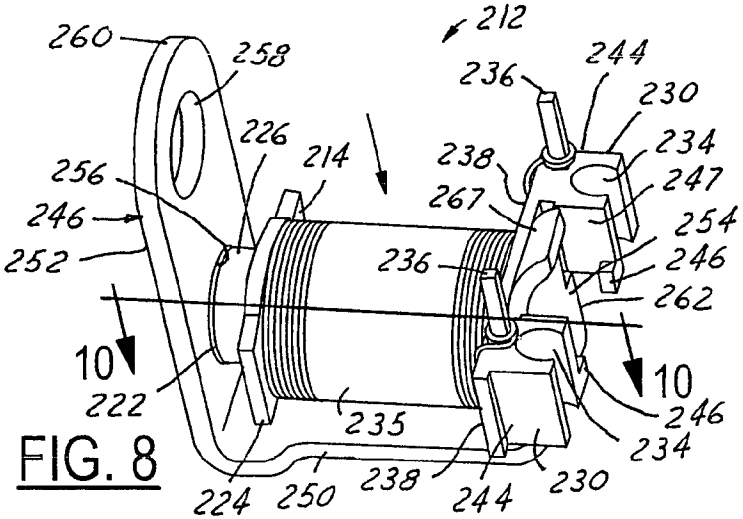
FIG. 8 is a perspective view of a portion of the solenoid valve assembly of FIG. 7 shown partially assembled.
Figure 9:
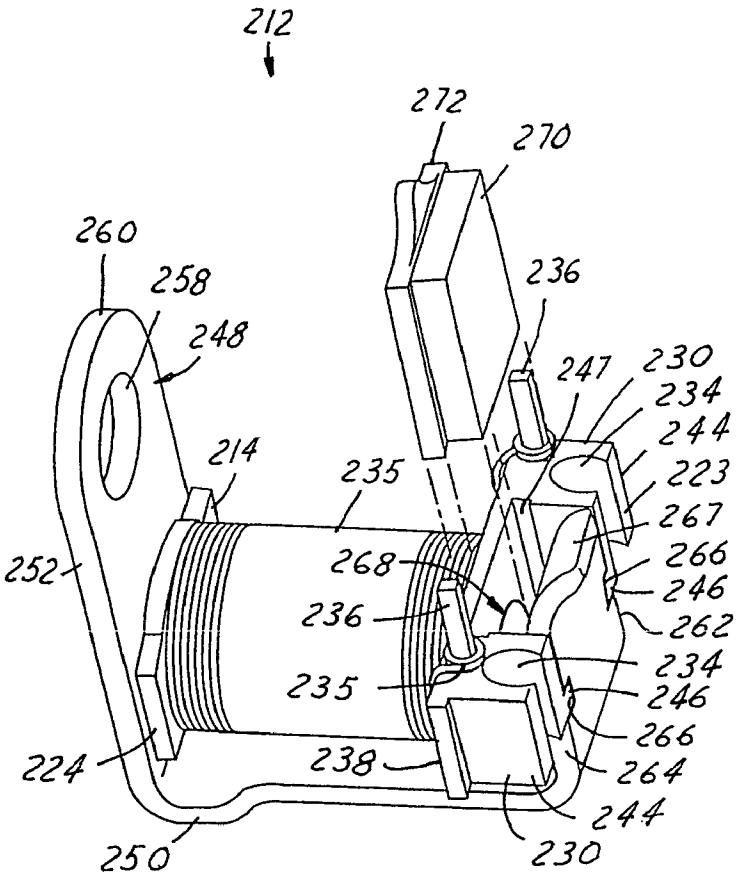
FIG. 9 is a perspective view of a portion of the solenoid valve assembly of FIG. 7 shown partially assembled and partially exploded.

The end wall 254 has opposite sides 262, 264 (FIGS. 6, 7 and 9) with at least one of the sides and shown here as both sides 262, 264 having slots 266 (FIGS. 7, 9 and 10) extending laterally into the sides 262, 264. As best shown in FIGS. 6 and 9, the slots 266 are generally opposite one another and located to receive the tabs 246 when the coil body 214 and solenoid housing 248 are assembled together. To facilitate assembly, the end wall 254 preferably has a free end 267 that is bent or curled. It should be recognized that the slots 266 are oriented to receive the tabs 246 as the nose portion 226 is being received in the opening 256 of the solenoid housing 248.

The solenoid housing 248 is preferably formed from bent stamped steel, though it should be understood that other manufacturing processes, such as molding, for example could be used in combination with other materials preferably having ferromagnetic properties. The openings 256, 258 and the slots 266 are preferably formed prior to bending the steel into its generally U-shaped configuration, though they may be formed afterward, if desired.

As shown in FIG. 9, upon aligning the nose portion 226 of the coil body 214 with the opening 256, and the tabs 246 with the slots 266, the coil body 214 is moved laterally between the end walls 252, 254 so that the nose portion 226 is received in the opening 256, while at the same time the tabs 246 are received in there respective slots 266. Desirably, when the flange 224 on the coil body 214 abuts the end wall 252, the tabs 246 are received and maintained in the slots 266 and the end wall 238 of the coil body 214 is received between the end walls 252, 254 of the housing 248. With the tabs 246 received in the slots 266, the pocket 247 defines in part a space 268 between the end wall 254 of the coil housing 248 and the wall 238 of the coil body 214. The pocket 247, and thus the space 268 is sized to receive a magnet 270 and a plate 272, wherein the plate 272 is preferably constructed of a ferromagnetic material, such as steel for example.

The magnet 270 and the plate 272 are inserted into the space 268 with the magnet 270 positioned adjacent the end wall 254 and the plate 272 positioned adjacent the end of the coil body 214. Desirably, the combined thickness of the magnet 270 and the plate 272 creates a line-to-line, or a slight press fit within the space 268, with a snug fit resulting between the components. By providing a somewhat enlarged entrance to the space 268, the curled lip or free end 267 facilitates assembly of the magnet 270 and plate 272 into the space 268. Accordingly, upon assembly of the magnet 270 and the plate 272 into the space 268, the position of the coil body 214 is maintained relative to the solenoid housing 248, as shown in FIG. 6. It should be recognized that in assembly, the individual thicknesses of the magnet 270 and the plate 272 can be adjusted, such as through providing various thicknesses for each, so that the desired fit of the magnet 270 and the plate 272 is attained within the space 268.

Upon assembling the magnet 270 and the plate 272 within the space 268, the solenoid valve assembly 212 is preferably potted or coated with a resinous epoxy to further maintain the individual component parts in their assembled state. The valve body 220 and a spring 274 (FIG. 11) may be inserted within the inner passage 218, as discussed in the previous embodiment, to complete the solenoid valve assembly 212. It should be recognized that the valve body 220 and the spring 274 can be inserted within the inner passage 218 at any stage of assembly, as desired.

The solenoid valve assembly 212 can then be attached to the carburetor body by aligning the reduced diameter portion 226 with an opening in the carburetor and inserting a fastener through the opening 258 and into the body of the carburetor. In one preferred embodiment, the valve body 220 can be driven between and maintained in extended and retracted positions to selectively permit flow through a passage, such as the air bleed passage 28 described with reference to the first embodiment solenoid valve assembly 12. The function and operation of the solenoid valve assembly 212 may be the same as the valve assembly 12 and thus, will not be further described.

It should be recognized that upon reading the disclosure herein, one of ordinarily skill in the art will readily recognize embodiments other than those disclosed herein, with those embodiments being within the spirit and scope of the following claims. Accordingly, the disclosure herein is intended to be exemplary, and not limiting. The scope of the invention is defined by the following claims.

We claim:

1. A carburetor, comprising:

a carburetor body;

a fuel and air mixing passage in the body;

an air bleed passage extending through at least a portion of the body and communicating with the fuel and air mixing passage;

a cavity extending into the carburetor body and communicating with at least a portion of the air bleed passage;

a solenoid housing having a through bore and an outer surface with a portion received by a friction fit within the cavity in the carburetor body;

a coil body received at least partially in the solenoid housing and having a valve passage; and a valve body received at least in part in the through bore and the valve passage for reciprocation between a first position to at least partially obstruct the air bleed passage and a second position permitting a relatively free fluid flow past the valve body in the air bleed passage.

2. The carburetor of claim 1 wherein the valve passage has a surface substantially adjacent at least a portion of the valve body to facilitate application of a magnetic force on the valve body to assist in moving the valve body between its first and second positions.

3. The carburetor of claim 2 wherein a generally annular gap is defined between the valve body and the surface of the valve passage so that a magnetic force can span the gap to facilitate moving the valve body between its first and second positions.

4. The carburetor of claim 1 further comprising a spring biasing the valve body toward one of its first and second positions and a magnet biasing the valve body to the other of its first and second positions.

5. The carburetor of claim 1 wherein the portion of the housing sized for a friction fit within the cavity in the carburetor body is cylindrical.

6. The carburetor of claim 1 wherein the solenoid housing has a reduced diameter end defining an annular shoulder to facilitate locating the solenoid housing within the cavity of the carburetor body.

7. The carburetor of claim 6 wherein the cavity in the body has a reduced diameter portion for receiving said reduced diameter end of the solenoid housing with a friction fit therebetween.

8. The carburetor of claim 6 wherein the solenoid housing has a main body that is larger in diameter than said reduced diameter end and said cavity in the carburetor body has an enlarged diameter portion for receiving said main body of the solenoid housing with a friction fit therebetween.

9. The carburetor of claim 6 wherein the cavity in the body has enlarged and reduced diameter portions with a shoulder defined therebetween, the shoulder in the cavity abutting the shoulder on the solenoid housing to facilitate locating the solenoid housing axially within the cavity in the body.

10. The carburetor of claim 3 wherein the solenoid housing and the valve body are constructed from a magnetic material.

11. The carburetor of claim 4 further comprising a steel plate between the magnet and the spring.

12. The carburetor of claim 1 wherein the coil body is constructed from a non-magnetic material.

13. The carburetor of claim 11 wherein the coil body is constructed from a polymeric material.

14. The carburetor of claim 1 wherein the coil body has a wire coil disposed about its outer surface and at least one flange extending outwardly from its outer surface with a pair of electrically conductive posts carried by said at least one flange providing a path for electrical communication to the wire coil.

* * * * *